US005211691A

United States Patent [19]

Sol

[11] Patent Number: 5,211,691

[45] Date of Patent: May 18, 1993

[54] TENNIS RACKETS

[75] Inventor: Hugo Sol, Grimbergen, Belgium

[73] Assignee: Donnay International S.A., Couvin, France

[21] Appl. No.: 618,294

[22] Filed: Nov. 27, 1990

[30] Foreign Application Priority Data

Nov. 26, 1990 [DE] Fed. Rep. of Germany ..... 4037568

[51] Int. Cl.[5] ..... A63B 49/02

[52] U.S. Cl. ..... 273/73 C; 273/73 G

[58] Field of Search ..... 273/73 R, 73 C, 73 D, 273/73 F, 73 J, 73 G

[56] References Cited

U.S. PATENT DOCUMENTS

| | | | |
|---|---|---|---|
| 3,801,099 | 4/1974 | Lair | 273/73 C |
| 4,153,249 | 5/1979 | Plagenhoef | 273/73 C |
| 4,177,990 | 12/1979 | Kajiwara | 273/73 C |
| 4,212,461 | 7/1980 | Cecka | 273/73 F |
| 4,662,634 | 5/1987 | Winkler | 273/73 C X |
| 4,664,380 | 5/1987 | Kuebler | 273/73 C |
| 4,875,679 | 10/1989 | Movilliat | 273/73 C |
| 4,919,438 | 4/1990 | Yoneeyama | 273/73 C |

FOREIGN PATENT DOCUMENTS

| | | | |
|---|---|---|---|
| 340127 | 11/1989 | European Pat. Off. | 273/73 C |
| 2450114 | 10/1980 | France | 273/73 C |
| 755257 | 8/1956 | United Kingdom | 273/73 C |
| 2067901 | 8/1981 | United Kingdom | 273/73 C |
| 2218642 | 11/1989 | United Kingdom | 273/73 J |

*Primary Examiner*—V. Millin
*Assistant Examiner*—William E. Stoll
*Attorney, Agent, or Firm*—Townsend and Townsend Khourie and Crew

[57] ABSTRACT

A tennis racket is disclosed which has a frame joined to a longitudinally extending handle on an axis of symmetry of the racket. A handle of the frame defines annular opening which is covered by stringing tensioned in a plane extending across the opening. Two connecting arms attach the handle to the frame and a reinforcement member between the two connecting arms defines a portion of the annular opening. The height of the main portion of the frame in a direction perpendicular to the stringing plane is at least essentially constant between the connecting arms and an end portion of the frame, the width of the frame in the main portion thereof being between about 50% and 75% of the frame height. Further, an end portion of the frame, including the top end thereof, has a cross section which increases from the main portion of the frame to the top end. The racket frame further has a cross section defined by a tubular profile having a reentrant concave portion at the outer side thereof, upper and lower summit areas adjoining the surface of the frame facing the annular opening thereof, and substantially flat wall portions therebetween which are inclined relative to the stringing plane at an angle between 25° and 65°.

34 Claims, 4 Drawing Sheets

TENNIS RACKETS

When designing tennis rackets, it is attempted to keep the vibrations and deformations which occur during the striking of a ball as low as possible by selecting the shapes of the racket, the materials and/or certain dimensions or by positively influencing these vibrations and deformations by means of additional elements integrated in the structure of the racket or attached to the latter.

The object of the invention is to achieve a tennis racket having a relatively rigid head and relatively flexible connecting arms which provides an optimal behaviour with respect to vibrations in connection with minimal deformation in the plane of the racket when striking a ball and with which the best possible playing properties can be reached.

This object is attained according to the invention in a racket in which: the head comprises a main portion in which the height of the frame measured perpendicularly to the plane of the stringing is at least essentially constant and extends from the end of the connecting arms to beyond the region of the head of the racket having the maximal head width as measured in the plane of the stringing perpendicularly to the longitudinal axis, and an end portion located at the opposite from the handle, the width of the frame measured in the plane of the stringing increases in the end portion towards the top end, the handle comprises a core which determines the mechanical stiffness in flexion with respect to the plane of the stringing, the mechanical stiffness in flexion in a plane perpendicular to the plane of the stringing and the mechanical stiffness in torsion, and a layer which covers the core and determines the maximal height and the maximal width of the handle without substantially influencing the mechanical stiffnesses thereof.

Owing to these features the frame resists to the deformations which occur in the plane of the racket during the striking of a ball and provides a substantial improvement during the return of the ball since less energy is used for the deformation of the head and therefore more energy is available for the effectiveness of the return of the ball.

Preferably the handle comprises a main portion opposite from the head of the racket, in which the height of the core is at least essentially constant and comprised between 40% and 70% of the height in the main portion of the head, and the height of the frame in the connecting arms varies between the height of the frame in the main portion and the height of the core at the end of the handle close to the head.

The behaviour with respect to vibration of the frame of a tennis racket after the striking of a tennis ball is mainly determined by the two lowest flexion modes of a fully free racket. These flexion modes typically occur at two resonant frequences, the first one at about 130 Hz to 180 Hz and the second one at about 350 Hz to 450 Hz.

According to the special design of the tennis racket according to the invention it is possible to distribute the nodal lines of these flexion modes in such a manner that vibrations are minimized, the sweet-spot area is increased and a substantial improvement of the effectiveness of the return of the ball is obtained.

Further advantages and details of the invention will be described in the following description.

The invention will now be explained with reference to the drawings in which.

Figure 1:
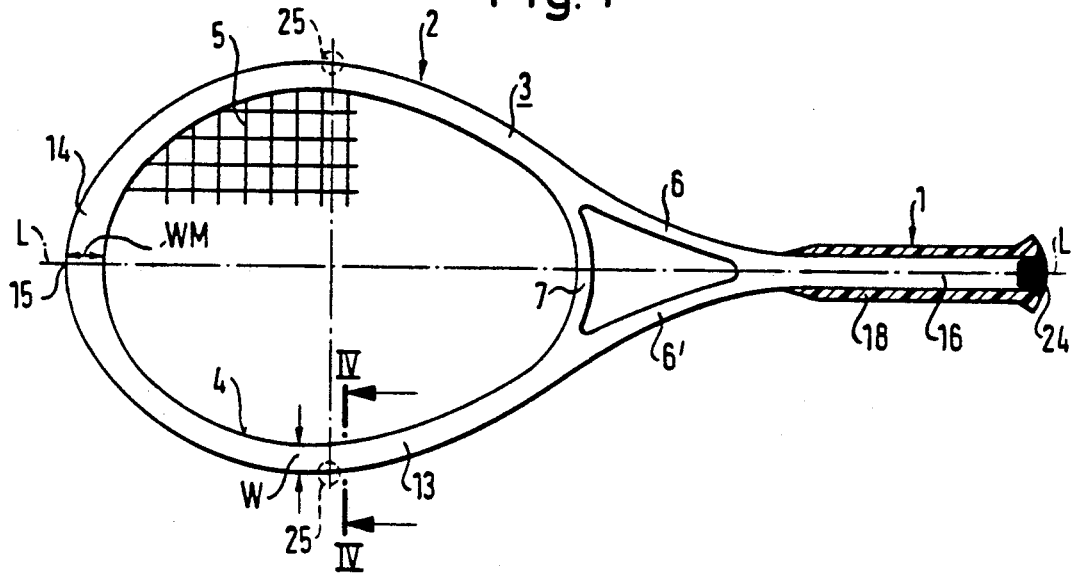
FIG. 1 is a plan view of a tennis racket according to the invention.
Figure 2:
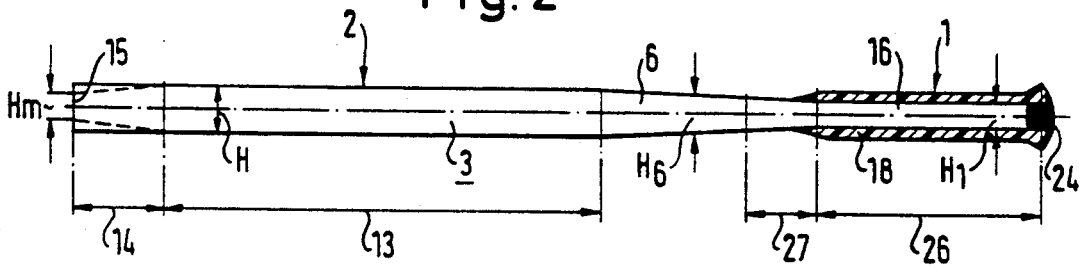
FIG. 2 is a side view of the racket of FIG. 1.
Figure 3:
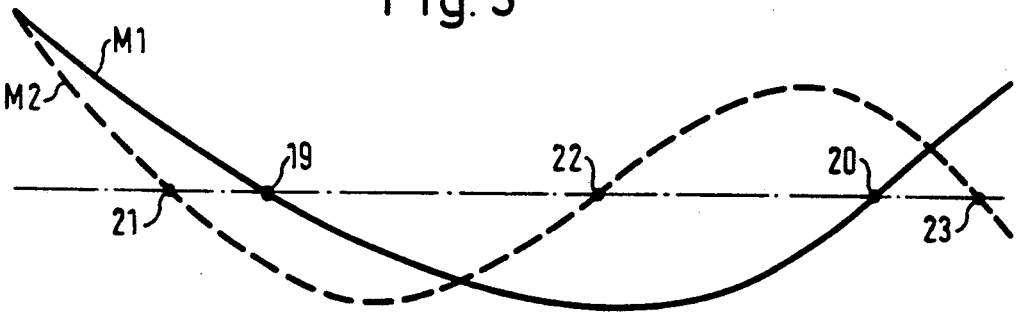
Figure 4:
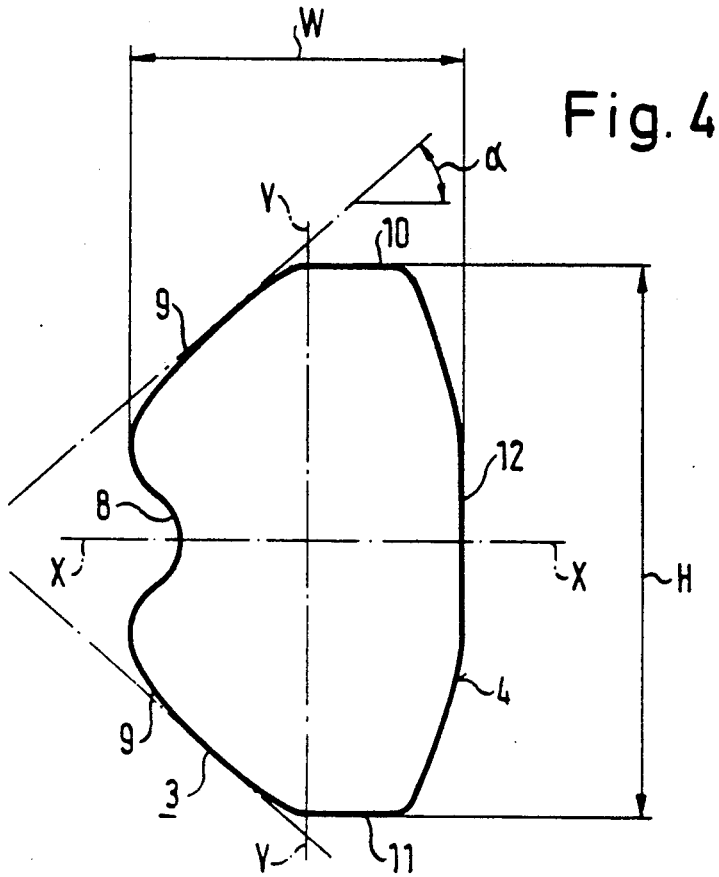
Figure 5:
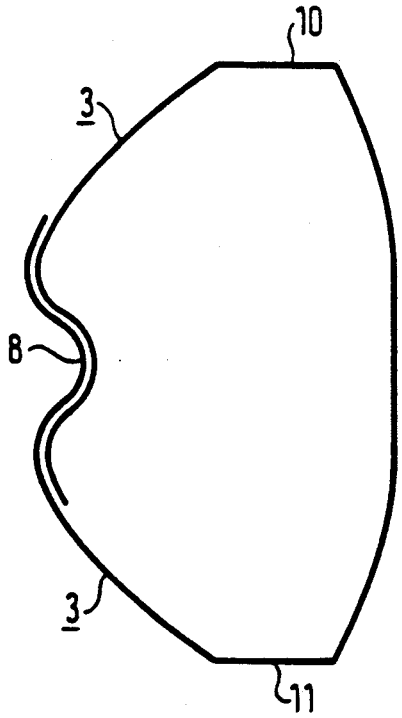
Figure 6:
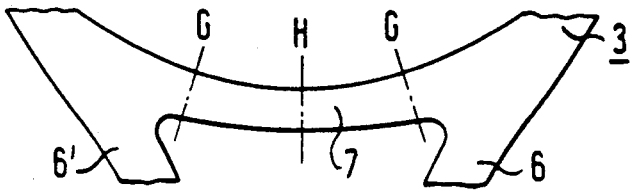
Figure 7A:
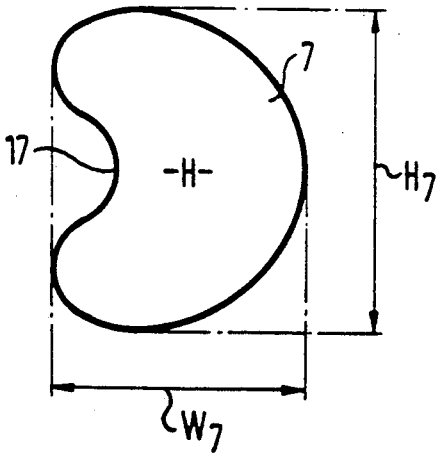
Figure 8:
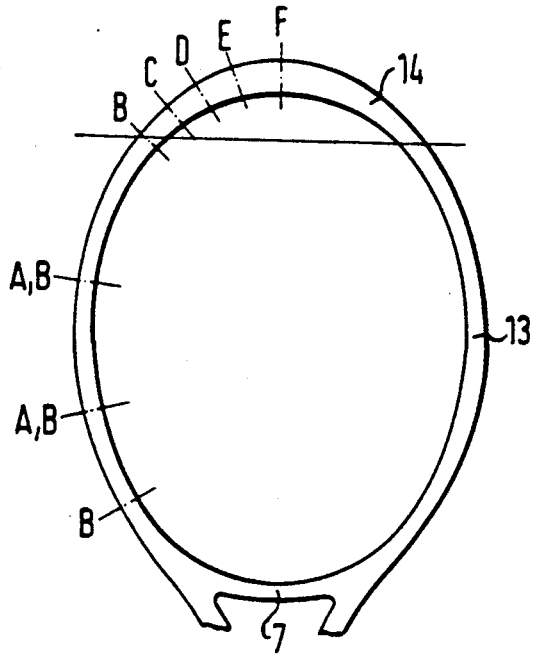
Figure 9A:
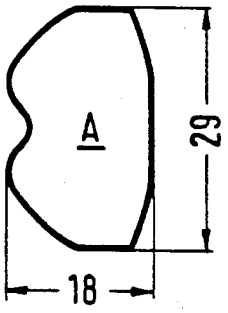
Figure 9B:
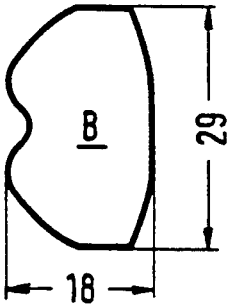
Figure 9C:
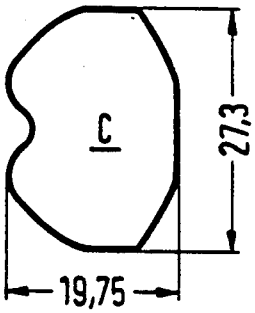
Figure 9D:
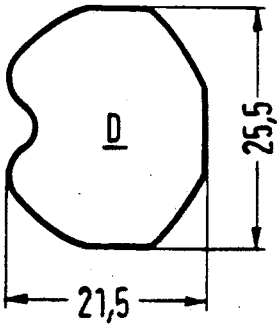
Figure 9E:
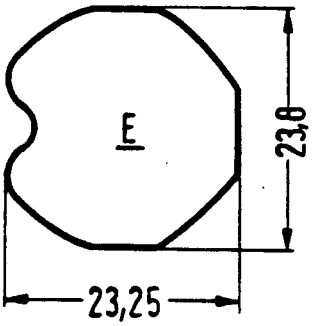
Figure 9F:
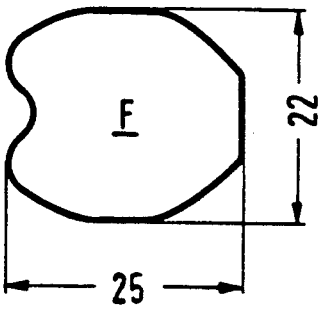

FIG. 3 is a schematic illustration of the vibration modes of the racket of FIGS. 1 and 2 as seen from the side thereof, FIG. 4 is a cross section of the frame of the tennis racket in the head portion taken along line I—I in FIG. 1, FIG. 5 is a similar cross section illustrating a variant of the invention, FIG. 6 is a partial plan view illustrating a reinforcement member located between the connecting arms of the racket of FIG. 1, FIGS. 7*a* and *b* shows cross sections of the reinforcement member according to FIG. 6, FIG. 8 is a partial plan view showing the head portion of the racket with several section lines, and FIGS. 9(*a*)–(*f*) show cross sections according to the section lines A to F in FIG. 8.

The tennis racket illustrated in plan view in FIG. 1 comprises in a usual manner three successive portions arranged along a longitudinal axis of symmetry LL:

a handle portion 1, a head portion 2 formed by a frame 3 of generally oval planar shape circumscribing an aperture 4, and two connecting arms 6 which are formed integrally with the frame 3 as extensions thereof and extend into the handle portion 1.

Further, the racket comprises a yoke piece or reinforcement member 7 which is joined integrally between the connecting arms 6 and delimits the aperture 4 on the side of the handle 1.

A stringing 5 is tensioned across the aperture 4 and lies generally in a plane, the individual strings forming the stringing extending in directions parallel and perpendicular to the longitudinal axis of symmetry LL and are led through passages provided through the frame of the head portion 2 and through the reinforcement member 7 as well known in the art.

The frame 3 comprises a profile having according to the invention the typical cross section illustrated in FIG. 4. This profile preferably is formed as a hollow closed thin-walled profile the interior of which can be filled with a material having practically no influence on the mechanical properties of the profile.

Having reference to the axes indicated in FIG. 4, XX is the axis lying in the plane of the stringing and YY is the axis perpendicular to the plane of the stringing. The outline of the cross section can be circumscribed by a midsymmetric triangle the basis of which lies on the stringing side. The profile comprises a concavely reentrant portion or groove 8 on the XX axis and on the outer side located opposite from the aperture 4, in order to accommodate the strings (not represented on the drawing) between two passages leading to the aperture 4 of the frame 3. In order to withstand without excessive inward deformation the efforts exerted by the stringing onto the frame both in static conditions and in dynamic conditions, the wall portions 9 of the profile which join the groove 8 to the upper and lower summit areas 10 and 11 located on the YY axis and being substantially flat are inclined with respect to the plane of the stringing at an angle $\alpha$ comprised between 25° and 65°, preferably 45°, subject to other conditions as it will be later apparent. The inner side 12 of the profile can be substantially straight at least in its middle portion and is preferably slightly curved in the direction of aperture 4. According to the invention, the shape and proportions of the above described typical cross section vary in the handle 1, in the connecting arms 6 and in the various portions of the head 2 which will now be explained in connection with FIGS. 1 and 2.

The head 2 of the racket comprises a main portion 13 commencing at the ends of the connecting arms 6, 6' and extending beyond the region of maximal width of the head 2, and an end portion 14 which extends between the top end 15 of the head 2 opposite from the handle 1 and the main portion 13. In the main portion 13 the height H of the frame 3, i.e.: the distance between the upper and lower summits 10 and 11 of the cross section measured perpendicularly to the plane of the stringing, or in other words along the YY axis at FIG. 4, is constant, or at least substantially constant. According to a first preferred embodiment the height in the end portion 14 of the frame is identical to the height H of the main portion 13 of the frame 2, i.e. the height of the frame remains constant between top end 15 and the connecting arms 6.

According to a second embodiment the height H of the frame 3 decreases in the end portion 14, preferably continuously from the height H of the main portion 13 to a minimal height Hm at the top end 15 of the frame 3 on the longitudinal axis LL of between 50% and 100% of the height H of the frame 3 in the main portion 13.

Simultaneously, the width W of the frame 3, measured in the plane of the stringing, or along the XX axis in FIG. 4, increases in the end portion 14, preferably continuously, from the width W of the main portion 13 to a maximal width WM at the top end 15 of the frame 3, of between 100% and 200% of the width W in the main portion 13.

An advantage of the second embodiment consists in the fact that the outer perimeter of the profile is constant along the whole frame 2. This fact makes the manufacture of frame 3 especially easy.

Preferably there is a ratio of about 3:5 between the width W and the height H of the frame 3 in the main portion 13.

Preferably in the second embodiment the length of the main portion 13 of the head 2, measured parallel to the longitudinal axis LL, is comprised between 1:4 and 1:3 of the total length of the racket.

By the special design for the cross sections a racket of high stability is obtained which has at the same time a relatively low mass. These cross sections provide big in and out of plane bending stiffnesses and the special geometry of the cross sections for the head allows a considerable reduction of the wall thickness of the cross section which results in the above mentioned mass reduction. It is of importance that due to these cross sections also the torsion inertia moment can be increased for a lower mass.

Due to the reduction of mass it is possible—without increasing the usual total weight of a racket—to add concentrated masses 25 on the frame in the sweet-spot zone and/or at the free end of the handle 24 as schematically shown in FIG. 1. This results in an increase of the sweet-spot zone and an improvement in the vibrational behaviour of the racket.

The handle 1 comprises a core 16, formed by the extensions of the connecting arms 6, 6', which determines the three essential mechanical stiffnesses of the handle 1:

the flexural mechanical stiffness in the plane of the stringing 5, the out of plane bending stiffness in the principle zone of the handle and the torsional mechanical stiffness about the longitudinal axis LL.

The height H1 of the core 16 of the handle 1 is substantially constant over the essential length thereof and this height H1 is comprised in a range of between 40% and 70% of the height H of the frame 3 in the main portion 13 of the head 2.

The height H6 of the profile in the connecting arms 6, 6' varies, also preferably continuously, from the height H of the frame 3 in the main portion 13 of the head 2 to the height H1 of the core 16 of the handle 1.

The cross section of the core 16 preferably is rectangular with the long side being parallel to the stringing plane. The height of the core 16 must be kept sufficiently low as the out of plane bending stiffness in the principle zone 26 of the handle has to be very low. In the transition zone 27 the height of the core 16 can continuously increase.

As shown in FIGS. 1 and 2, the handle 1 also comprises a cover layer 18 around the core 16. The purpose of the cover layer 18 is to determine the maximal height and thickness of the handle 1 for a suitable handgrip. The material of the cover layer 18 is such that the mechanical stiffnesses of the handle 1 are not substantially different from those which are determined by the core 16 alone. The cover layer 18 typically consists of a foam which provides the support for the leather band surrounding the grip of the racket.

Although the core of the handle has been described as being constituted by extensions integral with the connecting arms 6, 6', it can be made as a separate component and solidly joined to the ends of the connecting arms.

As a variant illustrated in FIG. 5, the profile can be made out of sheets of composite material and be reinforced in the region of maximal strain and deformation, i.e.: the region of the outer groove 8 by overlapping two plies of the sheet material. The sheet can then be as thin as 0.75 mm, which ensures a wall thickness of 1.5 mm in the region of the outer groove 8. The overlap length typically is about 15 mm.

The properties of this overlapped cross section result in an increase of the in plane stiffness and torsional stiffness while the mass is significantly decreased compared to traditional cross section properties. Additionally the most solicitated zone has an increased thickness and thus an increased resistance for stringing and ball impact.

Figure 7B:
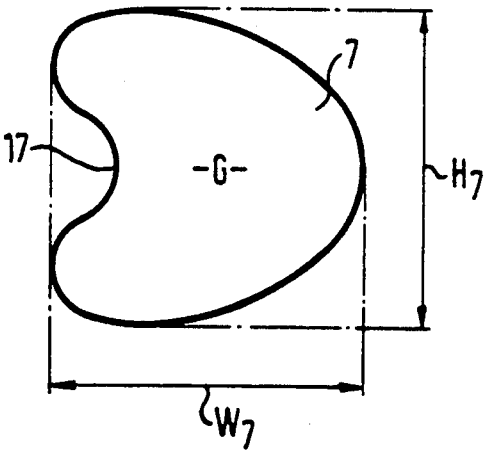

FIGS. 6 and 7 show the reinforcement member (7) being arranged between the two connecting arms (6, 6').

This reinforcement member (7) is also formed as a preferably hollow closed profile having a concave reentrant portion or groove 17 at its outer side for accommodating the strings between consecutive through passages. Preferably the in plane bending stiffness of the reinforcement member (7) or yoke piece decreases slightly towards the middle of this yoke piece.

FIG. 7 shows cross sections according to the lines G and H in FIG. 6 and in connection with these cross sections typical measures (in mm) are shown in FIG. 7 as examples.

The reinforcing member (7) has a nearly circular section at both extreme ends (section G) and a decreasing width W; towards the middle of the yoke piece together with an increase of the section height $H_7$ in such a way that the section contour remains constant (section H).

Advantageously, the hollow profile of the frame 3, of the connecting arms 6, 6', of the handle 1, and of the reinforcement member 7 is made of preimpregnated materials or so called "prepregs", composites comprising fibers in a matrix of resin, the fibers being preferably carbon fibers, but can also be aramid or glass fibers, or also a mixture of various types of fibers. The resin is preferably an epoxy resin. The interior of the hollow profile can be filled with a supporting material for the prepregs, like foam, but this material has practically no influence on the mechanical properties of the profile.

With such materials and the typical cross sectional shapes according to the invention the wall of the profile can be as thin as 0.75 to 1.0 mm which results in a considerable mass reduction.

FIGS. 8 and 9 show the evolution of the cross sections in the main portion (13) and an example for the evolution of the cross section in the end portion (14) of the racket according to the invention. It is to be mentioned that according to an already described preferred embodiment of the invention the cross section in the end portion 14 has a constant height but the width changes substantially as shown in cross sections B to F in FIG. 8 and 9.

FIG. 9 shows the cross sections A to F as given by the corresponding section lines in FIG. 8. Preferably the wall thickness of the profile is 0.75 mm and in the area between the sections A, B this wall thickness preferably is 1.0 mm.

The values for the width and the height given in the sections in FIG. 9 are examples of a preferred embodiment and are given in millimeters.

Due to these special cross sections the in plane bending moment due to stringing and ball impact has an increased value towards the top of the head of the racket. The height of the section in the end portion (14) can be reduced in such a way that the circumference and thus the mass of the cross section can remain substantially constant.

Owing to the above described features, the deformation of the racket head 2, which occurs under the strains exerted by the stringing 5 upon striking a ball, can be kept as low as possible even when the ball hits the stringing 5 outside the sweet-spot, i.e.: the region of the stringing about the geometrical center of the head 2. Due to this reduced deformation, the energy available for returning the ball is increased.

In conventional rackets, the greatest deformation occurs in the end portion 14 of the head 2. In the racket according to the invention, the deformation in the end portion 14 is substantially reduced, which increases the energy available for returning the ball, and has also the effect of enlarging the sweet-spot region of the stringing 5.

Advantageous and preferred dimensions of the racket and its various parts are as follows:

overall length: between 675 mm and 695 mm, preferably about 682 mm;

height H1 of the core 16 of the handle 1: between 11.5 mm and 21 mm and preferably between 16 mm and 17 mm;

height H of the frame 3 in the main portion 13 of the head 2: between 26 and 35 mm, preferably 29 mm;

width W of the frame in the main portion of the head: between 15 and 21 mm, preferably 18 mm;

minimal height Hm of the frame 3 at the top end 15 of the end portion 14: in the embodiment with decreasing height this value is 22 mm and in the embodiment with constant height this value is between 26 and 35 mm, preferably 29 mm;

maximal width WM of the frame 3 at the top end 15 of the end portion 14: about 25 mm;

maximal height $H_7$ at the center of the reinforcement member: about 12 mm;

height of the reinforcement member at the transition to the connecting arms 6, 6': about 11 mm;

minimal width $W_7$ at the center of the reinforcement member 7: about 10 mm;

width of the reinforcement member at the transition to the connecting arms 6, 6': about 11 mm.

The behaviour of the racket with respect to vibrations and further features of the racket will now be described and explained in connection with FIG. 3, and other advantages of the invention will appear from this description.

The vibrations which occur in the racket upon striking a ball are essentially determined by the two vibration modes of a fully free racket. These bending mode shapes are associated with two resonant frequencies having approximately a value between 130 Hz and 180 Hz for the first mode shape M1 and between 350 Hz and 450 Hz for the second mode shape M2 as illustrated in FIG. 3. The total vibration amplitude of a tennis racket after ball impact can be composed as a contribution of the amplitudes of the mode shapes M1 and M2, each with a time dependant weighting coefficient W1 (t) and W2 (t):

$$\text{Total vibration amplitude} = W1\,(t)\cdot M1 + W2\,(t)\cdot M2$$

The relative values of the weighting coefficients W1 and W2 are mainly dependant from the position where the tennis ball hits the strings in the head of the racket.

Each vibration mode has a certain number of vibration nodes where the vibration amplitude is zero. Vibration mode M1 of lower frequency has two nodes 19 and 20, and vibration mode M2 of higher frequency has three nodes 21, 22 and 23, all these nodes being distributed along the length of the racket.

The position of the vibration nodes is of significance as regards the energy transmitted to the player who holds the racket when striking a ball. When the ball hits the stringing 5 at one of the vibration nodes, then the corresponding vibration mode will practically not be activated. In this case, the above mentioned weighting factor is zero. Conversely, when the ball hits the racket at a distance from the vibration nodes, the corresponding vibration mode is activated. The effect of the weighting factor increases as a function of the distance between the hitting point and the considered vibration node.

Owing to the above described design of the racket frame 3, one of the vibration nodes of each vibration mode lies as close as possible to the region of the sweet-spot of the racket, which minimizes the activation of the vibration modes. Further, one of the vibration nodes of each vibration mode lies in the handle, and more precisely in the region of the handle 1 which is grasped by the hand of the player, which minimizes the vibrational energy transmitted to the hand of the player.

Finally, it is possible to take advantage of the weight reduction of the racket committed by the design of the frame explained herein above, for attaching to the racket one or more masses at selected points of regions of the racket in order to influence the position of the nodes of the two fundamental vibration modes.

A first mass (24) can be fixed at the free end of the handle of the racket, in order to displace the vibration nodes located in the handle towards the free end of the latter, such that these nodes are located substantially at the middle of the hand of the player.

Two masses (25) can be fixed to the frame, substantially on the transverse symmetry axis of the head in order to displace the vibration nodes located in the head away from the top end 15 thereof, such that these nodes are located substantially at the center area of the head, thus also at the sweet-spot region of the head. A second consequence of these inertia masses attached to the head is to enlarge the sweet-spot region, whereby the striking of a ball at a point distant from the geometrical center of the head leads to a lower activation of the vibration modes of the racket. A third consequence of these masses is to increase the torsional inertia of the head and therefore to enlarge the sweet-spot region along the axis between these two masses in the plane of the strings.

I claim:

1. A tennis racket having a longitudinal axis of symmetry which comprises a handle extending substantially along the longitudinal axis, a head defined by a frame having an annular opening, stringing mounted on said frame and tensioned across said opening substantially along a plane, two connecting arms extending between the head and the handle and directly joining the head to the handle, and a reinforcement member extending between the two connecting arms, the head comprising a main portion in which a height of the frame measured perpendicularly to the plane of the stringing is at least essentially constant and extends from the ends of the connecting arms to beyond a region of the head of the racket having a maximal head width as measured in the plane of the stringing perpendicularly to the longitudinal axis, a cross-sectional width of the frame in the main portion corresponding to a value of between 50% and 75% of the height of the frame, and an end portion located at the opposite end from the handle, a width of the cross section of the frame measured in the plane of the stringing increasing in the end portion towards a top end of the frame, wherein said reinforcement member is arranged between the two connecting arms, the reinforcement member delimiting the opening of the frame on the side of the handle and being provided with apertures for receiving strings of the stringing in the same manner as the frame surrounding the opening, and wherein said reinforcement member has a height which increases in the direction of its center whereas the width of the cross section decreases.

2. Tennis racket according to claim 1, wherein the width of the cross section of the frame in the end portion increases, starting from the width of the frame in the main portion, up to a value at the end of the head greater than twice and no more than about three times the width of the frame in the main portion.

3. Tennis racket according to claim 2, wherein the increase of the width of the frame is continuous.

4. Tennis racket according to claim 1, wherein the height of the frame in end portion is substantially the same as the height of the frame in the main portion.

5. Tennis racket according to claim 1, wherein the height of the frame in the end portion decreases to a value greater than about one-half and no more than about twice the height of the frame in the main portion.

6. Tennis racket according to claim 5, wherein the decrease of the height of the frame is continuous.

7. Tennis racket according to claim 5, wherein the minimum height of the frame in the end portion having decreasing height is about 22 mm.

8. Tennis racket according to claim 1, wherein the overall length of the racket measured between the top of the frame and an end of the handle is comprised between about 675 mm and 695 mm.

9. Tennis racket according to claim 8, wherein the overall length of the racket is about 682 mm.

10. Tennis racket according to claim 1, wherein the handle includes a main portion having a length between about 1:4 and 1:3 of an overall length of the racket.

11. Tennis racket according to claim 1, wherein the height of the frame in the main portion is between 26 and 35 mm.

12. Tennis racket according to claim 11, wherein the height of the frame in the main portion is 29 mm.

13. Tennis racket according to claim 1, wherein the width of the frame in the main portion is between 15 and 21 mm.

14. Tennis racket according to claim 13, wherein the width of the frame in the main portion is 18 mm.

15. Tennis racket according to claim 1, wherein the height of the frame in the end portion with constant height is between 26 and 35 mm.

16. Tennis racket according to claim 15, wherein the height of the frame in the end portion with constant height is about 29 mm.

17. Tennis racket according to claim 1, wherein the maximum width of the cross section of the frame in the end portion is about 25 mm.

18. Tennis racket according to claim 1, wherein the head, the connecting arms and the core of the handle are made of prepeg materials including fibers selected from the group consisting of carbon fibers, aramid fibers, glass fibers and a mixture of said fibers, and a matrix of epoxy resin, said fibers and said matrix constituting a composite material.

19. Tennis racket according to claim 2, wherein the reinforcement member has in its center a cross-sectional width of about 10 mm and in its transition portion close to the connecting arms a cross-sectional width of about 11 mm.

20. Tennis racket according to claim 19, wherein the reinforcement member has in its center a height of about 12 mm and in its transition area close to the connecting arms a height of about 11 mm.

21. Tennis racket according to claim 19, wherein the length of the periphery of the cross section of the reinforcement member is essentially constant, irrespective of the position of the cross section along the reinforcement member.

22. Tennis racket according to claim 1, wherein the frame of the racket is made out of a tubular thin-wall closed profile having a reentrant concave portion at the outer side thereof opposite from the annular opening, and two wall portions joining the concave portion to upper and lower summit areas of the profile, said wall portions being inclined with respect to the plane of the stringing at an angle $\alpha$ comprised between 25° and 65°.

23. Tennis racket according to claim 22, wherein said wall portions are inclined at an angle of 45° with respect to the plane of the stringing.

24. Tennis racket according to claim 22, wherein said profile is reinforced in the region of the outer reentrant concave portion.

25. Tennis racket according to claim 24, wherein the profile is made out of a composite material and said reinforcement comprises overlapping two plies of said composite material.

26. Tennis racket according to claim 25, wherein the thickness of said composite material is 0.75 mm.

27. Tennis racket according to claim 25, wherein the overlap length is about 15 mm.

28. Tennis racket according to claim 22, wherein the thickness of the wall of said profile is about 1 mm.

29. Tennis racket according to claim 1, wherein the height of the frame in the connecting arms varies between the height of the frame in the main portion and the height of the core at the end of the handle close to the head.

30. Tennis racket according to claim 29, wherein the contour of the connecting arms reduces from the head portion to the handle and the overlap length of the composite material forming the arms increases from the head portion to the handle.

31. A tennis racket according to claim 1, wherein said value of said cross-sectional width of the frame is between about 65% and 75% of said height of the frame.

32. A tennis racket according to claim 1, wherein said cross-sectional width of the frame and the height of the frame have a ratio of between about 3:5.

33. A tennis racket having a longitudinal axis of symmetry comprising a handle extending substantially along the longitudinal axis, a head defined by a frame having an annular opening and adapted to be provided with stringing mounted on said frame and tensioned across said opening substantially along a plane, connecting arms extending between the head and the handle, a reinforcement member extending between the connecting arms, the frame being formed of a tubular, thin walled, closed profile, said profile being defined by a reentrant concave portion at an outer side of the frame opposite from the annular opening, upper and lower summit areas, and first and second, substantially flat wall portions joining the concave portion to the respective upper and lower summit areas, said substantially flat wall portions being inclined with respect to the plane of the stringing at an angle $\alpha$ of between about 25° and 65°.

34. Tennis racket having a longitudinal axis of symmetry which comprises a handle extending substantially along the longitudinal axis, a head defined by a frame having an annular opening, stringing mounted on said frame and tensioned across said opening substantially along a plane, two connecting arms extending between the head and the handle, and a reinforcement member extending between the two connecting arms, the head comprising a main portion in which a height of the frame measured perpendicularly to the plane of the stringing is at least essentially constant and extends from the ends of the connecting arms to beyond a region of the head of the racket having a maximal head width as measured in the plane of the stringing perpendicularly to the longitudinal axis, a cross-sectional width of the frame in the main portion corresponding to a value of between 50% and 75% of the height of the frame, and an end portion located at the opposite end from the handle, a width of the cross section of the frame measured in the plane of the stringing increasing in the end portion towards a top end of the frame, the height of the frame in the connecting arms varying between the height of the frame in the main portion and the height of the core at the end of the handle close to the head, and the contour of the connecting arms decreasing from the head portion to the handle, and the overlap length of the composite material forming the arms increasing from the head portion to the handle.

* * * * *

UNITED STATES PATENT AND TRADEMARK OFFICE

CERTIFICATE OF CORRECTION

PATENT NO. : 5,211,691

DATED : May 18, 1993

INVENTOR(S) : SOL

It is certified that error appears in the above-identified patent and that said Letters Patent is hereby corrected as shown below:

On the cover page, left column;

Amend Item [73] to read: -- Donnay International S.A.
Couvin, Belgium --

Signed and Sealed this

Seventeenth Day of October, 1995

Bruce Lehman

*Attest:*

BRUCE LEHMAN

*Attesting Officer*

*Commissioner of Patents and Trademarks*